US009417007B2

(12) United States Patent
Yochum et al.

(10) Patent No.: US 9,417,007 B2
(45) Date of Patent: Aug. 16, 2016

(54) MULTI-MATERIAL BASKET FOR REFRIGERATOR OR FREEZER

(75) Inventors: Jason R. Yochum, Princeton, IN (US); Jeffrey A. Ambrose, Evansville, IN (US)

(73) Assignee: SSW Holding Company, Inc., Fort Smith, AR (US)

( * ) Notice: Subject to any disclaimer, the term of this patent is extended or adjusted under 35 U.S.C. 154(b) by 312 days.

(21) Appl. No.: 13/314,886

(22) Filed: Dec. 8, 2011

(65) Prior Publication Data

US 2012/0146480 A1 Jun. 14, 2012

Related U.S. Application Data

(60) Provisional application No. 61/421,067, filed on Dec. 8, 2010.

(51) Int. Cl.
*F25D 25/02* (2006.01)

(52) U.S. Cl.
CPC ..... *F25D 25/022* (2013.01)

(58) Field of Classification Search
CPC ..... A47B 2088/0448; A47B 2210/0024; A47B 2210/04; A47L 19/04; F25D 25/022; F25D 25/025; B65D 7/14; B65D 7/16; B65D 7/18; B65D 7/20
USPC ..... 211/41.1–41.8, 126.1, 126.16, 126.8, 211/126.9, 133.2, 133.5; 312/334.6, 334.7, 312/404, 408; D32/55; D3/304, 306
See application file for complete search history.

(56) References Cited

U.S. PATENT DOCUMENTS

| | | | | | |
|---|---|---|---|---|---|
| 1,890,983 | A | * | 12/1932 | Griffith | 220/6 |
| 1,916,852 | A | * | 7/1933 | Sutton | 211/126.15 |
| 2,266,857 | A | * | 12/1941 | Field | 312/303 |
| 2,440,507 | A | * | 4/1948 | Geralds | 220/491 |
| D189,995 | S | * | 3/1961 | Crane | D3/314 |
| 3,517,825 | A | * | 6/1970 | Propst | 211/126.15 |
| 4,163,495 | A | * | 8/1979 | Drader | 206/506 |
| D276,281 | S | * | 11/1984 | Landgren | D3/309 |
| 4,788,832 | A | * | 12/1988 | Aoki et al. | 62/382 |
| 4,795,041 | A | * | 1/1989 | Remmers | 211/126.15 |
| D328,993 | S | * | 9/1992 | Rosenthal | D6/566 |
| D331,477 | S | * | 12/1992 | Michael et al. | D32/3 |
| D342,142 | S | * | 12/1993 | Jablonski | D25/2 |
| 5,480,039 | A | * | 1/1996 | Merl | 211/88.01 |
| 5,692,431 | A | * | 12/1997 | Herring | 99/426 |
| 5,810,179 | A | * | 9/1998 | Kleiman | 211/88.01 |
| 6,626,509 | B2 | * | 9/2003 | Remmers | 312/334.7 |
| D493,308 | S | * | 7/2004 | Nilsson et al. | D6/510 |
| 6,969,133 | B2 | * | 11/2005 | Compagnucci | 312/334.6 |
| D551,467 | S | * | 9/2007 | Kassanoff et al. | D6/510 |
| D551,483 | S | * | 9/2007 | Goodman et al. | D6/566 |

(Continued)

*Primary Examiner* — Patrick Hawn
(74) *Attorney, Agent, or Firm* — Marshall, Gerstein & Borun LLP

(57) ABSTRACT

A storage basket used for storing and displaying food products and packages in a refrigerator or freezer unit may include a single-material first portion including a bottom wall and an upright wall that extends away from the bottom wall. The bottom wall and the upright wall are imperforate, thereby creating a solid barrier to transfer and fall-through of materials contained in the storage basket. The storage basket may also include a single-material second portion coupled to and extending from the upright wall, and the second portion may include a plurality of perforations. The plurality of perforations may permit airflow around and about the materials contained in the storage basket.

18 Claims, 11 Drawing Sheets

(56) References Cited

U.S. PATENT DOCUMENTS

| | | | | |
|---|---|---|---|---|
| D568,646 | S * | 5/2008 | Snider | D6/510 |
| 7,406,833 | B2 * | 8/2008 | Ertz et al. | 62/115 |
| D603,197 | S * | 11/2009 | Hrovat | D6/510 |
| D609,509 | S * | 2/2010 | Hrovat | D6/510 |
| D616,202 | S * | 5/2010 | Whitlock et al. | D3/306 |
| 7,740,331 | B2 * | 6/2010 | Koo | 312/404 |
| D635,363 | S * | 4/2011 | Hertaus | D3/307 |
| 8,016,131 | B2 * | 9/2011 | Belokin et al. | 211/75 |
| 8,210,625 | B2 * | 7/2012 | Rotter et al. | 312/402 |
| 8,356,865 | B2 * | 1/2013 | Laible | 312/404 |
| D686,018 | S * | 7/2013 | Etherington et al. | D7/600.1 |
| D694,291 | S * | 11/2013 | Hottmann et al. | D15/89 |
| 2004/0079713 | A1 * | 4/2004 | Wendt et al. | 211/41.8 |
| 2006/0138063 | A1 * | 6/2006 | Johnson | 211/41.3 |
| 2008/0083636 | A1 * | 4/2008 | Devine | 206/423 |
| 2008/0156362 | A1 * | 7/2008 | Shin et al. | 134/201 |
| 2009/0211994 | A1 * | 8/2009 | Yang et al. | 211/41.4 |
| 2011/0232322 | A1 * | 9/2011 | Noel et al. | 62/441 |

* cited by examiner

MULTI-MATERIAL BASKET FOR REFRIGERATOR OR FREEZER

FIELD OF DISCLOSURE

A basket-type food storage device formed of multiple materials, for use in refrigerators and freezers.

BACKGROUND

Open-type baskets, drawers, trays, bins, and the like are used to store food, e.g., loose food items, packages, fruits, vegetables, small containers, netting bags of loose items, ice, and the like in refrigerators and freezers. Depending on a given OEM refrigerator/freezer manufacturer's desires, and for cost reasons, such storage baskets have been commonly formed of a single material, e.g., plastic, wire, sheet metal, or glass.

For example, such a single-material storage basket can be an open-top, rectangular-shaped basket totally formed from welded wire components, and then coated with a painted surface. Or they can be a tray entirely formed of injection-molded plastic, such as often used for so-called fruit/vegetable hydrator bins. Or they can be an open-top container totally formed from stamped and bent, or welded-up, sheet metal panels, and then powder-paint coated. One representative example of such a prior art form of a single-material refrigerator basket (steel wire) is typified by U.S. Pat. No. 5,486,046. Another version of a prior art one-material (molded plastic) drawer is found in U.S. Pat. No. 7,406,833.

There are benefits and disadvantages inherent in each type of such single-material basket for refrigerator and freezer use. For example, totally wire-formed baskets, while providing good airflow, will allow small loose food particles, ice chips, food "seepage" liquids (e.g., softened tomato "juices") and such flow through the wire basket bottom and then collect in and soil the bottom of the refrigerator liner, or litter the next shelf section below the wire basket. Also, while they allow for good visibility into the basket's interior, such wire baskets, especially the lower side portions and bottom thereof, are hard to clean.

Then, as to sheet metal-formed baskets, while the solid bottom portion prevents food particles, food seepage, ice particles and the like from falling through the basket onto the refrigerator liner, and also permits easy cleaning, such solid side wall and bottom baskets inhibit good airflow within and around the basket's contents.

Such single material storage baskets, trays, drawers and bins are regularly used in various designs of refrigerators, freezers, and refrigerator/freezer combination models. Such models can include but are not limited to so-called top-mount models, side-by-side models, bottom-mount models, French door models, upright freezers, and chest freezers. Such various refrigerator and freezer models each present significantly different interior configurations, support, and environmental characteristics for such baskets. (As used herein, the term "basket" shall be understood to equally include trays, drawers, and bins). For example, depending upon the associated refrigerator's or freezer's design, the configuration of such baskets can be generally rectangular; have straight, inwardly or outwardly slanted, or curved side walls; have a planar bottom wall, or instead have formed-in drip retention channels; and the like. Further, the aspect ratio for a storage basket (the ratio between the basket's height versus the front-to-back depth and/or the width of the basket) can be relatively large (deep basket), or can instead be small (shallow basket). Further, such baskets can be used for specialized food containers or packages (e.g., zipper-type containers, cans, jars, bottles, frozen packages), for sections of the refrigerator where or greater or less humidity is desired, for a temperature different from the rest of the refrigerator, for ice cubes, for foods needing significant (or no) airflow, and so forth. Thus, such storage baskets (including when used as hydration bins), must work with any and all such various overall designs and shaped environments for such refrigerators and freezers.

There remains a need for a refrigerator or freezer storage basket that is formed in an aesthetic design, is functional, easily cleanable, uses minimal material, permits proper visibility and airflow, and that is robust in strength to withstand the use associated with the residential and commercial refrigerators and freezers described above.

SUMMARY OF THE DISCLOSURE

An open-type storage basket for use in residential and commercial refrigerators and freezers is formed as an integral unit from a plurality of different materials, such as comprising two or more of a formed and welded array of wire members, a formed or stamped sheet metal panel, a glass panel, or a plastic component.

The resultant integral unit has sub-components, respectively formed from two or more different materials, such that when assembled together they create the needed basket with resulting benefits, of better airflow, easy cleanability, ready product visibility, prevention of food products and liquids from falling through the bottoms, robust strength, and the like.

DETAILED DESCRIPTION OF THE DISCLOSURE

In an embodiment of the present disclosure illustrated in FIGS. 1-4, a storage basket 10 may include an imperforate first portion 12 and a second portion 14 coupled to the first portion 12, wherein the second portion 14 includes a plurality of perforations 16.

Figure 1:
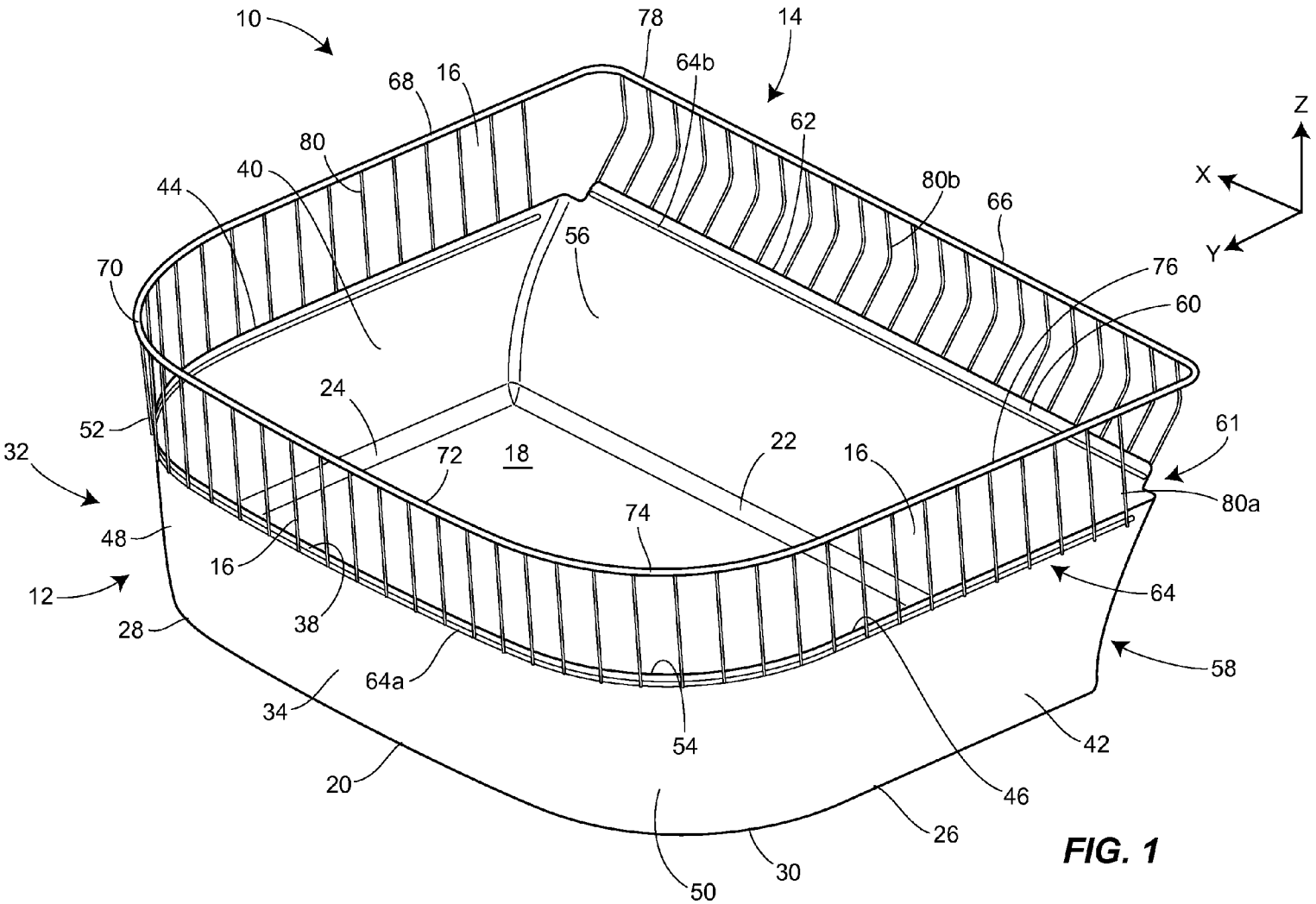
FIG. 1 is a perspective view of an embodiment of the storage basket.

Referring to FIG. 1, the single-material first portion 12 of the basket may include a bottom wall 18. The bottom wall 18 may be planar, and the plane formed by the bottom wall 18 may be substantially horizontal. As used herein, the term "horizontal" indicates a direction that is substantially coplanar with or substantially parallel to the X-Y plane of the reference coordinate system illustrated in FIG. 1. The term "vertical" indicates a direction that is substantially normal to the X-Y plane (i.e., the direction of the Z axis) of the reference coordinate system illustrated in FIG. 1. Instead of the planar configuration illustrated in FIG. 1, the bottom wall 18 may have any shape suitable for a particular application. For example, the bottom wall 18 may be curved or otherwise contoured, or may be partially curved and partially planar. The perimeter of the bottom wall 18 may be defined by a plurality of edges, such as a linear front edge 20 and a linear rear edge 22 that is offset from and parallel to the front edge 20. The perimeter of the bottom wall 18 may be laterally defined by a linear first side edge 24 and a linear second side edge 26 that each extends orthogonally from one of each of the terminal ends of the rear edge 22. An arcuate first transition edge 28 may extend between the first side edge 24 and the front edge 20 and an arcuate second transition edge 30 may extend between the second side edge 24 and the front edge 20. In further embodiments, the perimeter of the bottom wall 18 may be defined by any number or configuration of edges, and each edge may be linear, curved, or may have a combination of linear and curved portions. For example, the perimeter of the bottom wall 18 may be defined by a linear front edge 20 and a rear edge 22 that is offset from and parallel to the front edge 20, and a linear first side edge 24 and a linear second side edge 26 that is offset from and parallel to the second side edge 26 may each extend between corresponding terminal ends of the front edge 20 and the rear edge 22 such that the perimeter of the bottom wall 18 has a rectangular shape.

Figure 3A:
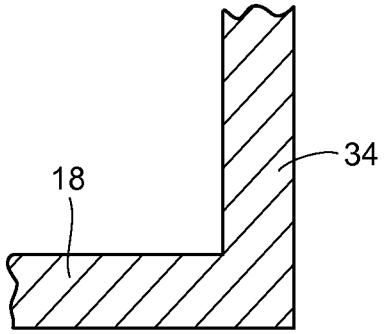
FIG. 3A is a partial sectional view of an embodiment of the storage basket, as seen along lines 3-3 of FIG. 2.
Figure 3B:
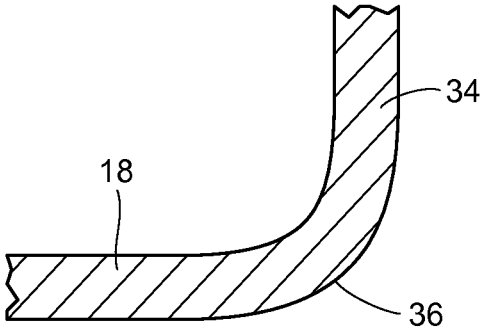
FIG. 3B is a partial sectional view of an embodiment of the storage basket, as seen along lines 3-3 of FIG. 2.

Referring again to FIG. 1, the single-material first portion 12 may include an upright wall 32 that extends away from the bottom wall 18 in a substantially vertical direction. The upright wall 32 may include a front wall 34 that intersects the front edge 20 of the bottom wall 18. The front wall 34 may perpendicularly extend from the bottom wall 18, as illustrated in FIG. 1, or may form any angle with the bottom wall 18 that is suitable for a particular refrigerator or freezer application. The front wall 34 may intersect the front edge 20 of the bottom wall 18 to form a right angle, as illustrated in FIG. 3A. However, a radiused portion 36 may extend along the front edge 20 between the bottom wall 18 and the front wall 34, as illustrated in FIG. 3B. The front wall 34 may be substantially planar, as illustrated in FIG. 1. Alternatively, the front wall 34 may be curved or otherwise contoured, or may be comprised of a combination of curved and planar surfaces. The front wall 34 may include a front wall top edge 38 that may be parallel to and vertically offset from the front edge 20 of the bottom wall 18. However, the front wall top edge 38 may extend in any direction or combination of directions and may be non-linear, segmented, and/or oblique when viewed along a horizontal reference plane.

Again referring to FIG. 1, the upright wall 32 may also include a first side wall 40 that intersects the first side edge 24 of the bottom wall 18 and a second side wall 42 that intersects the second side edge 26 of the bottom wall 18. Each of the first side wall 40 and the second side wall 42 may perpendicularly extend from the bottom wall 18, as illustrated in FIG. 1, or may form any angle with the bottom wall 18 that is suitable for a particular application. Each of the first side wall 40 and the second side wall 42 may intersect the first and second side edges 40, 42 of the bottom wall 18 to form a right angle, as illustrated in FIG. 3A, or the intersection may include a radiused portion 36 as discussed above and as illustrated in FIGS. 1 and 3B. Each of the first side wall 40 and the second side wall 42 may be substantially planar, as illustrated in FIG. 1. Alternatively, each or any one of the first side wall 40 and the second side wall 42 may be curved or otherwise contoured, or may be comprised of a combination of curved and planar surfaces. The first side wall 40 may be bounded by a first side wall edge 44 disposed along a top portion of the first side wall 40, and the first side wall edge 44 may be parallel to and vertically offset from the first side edge 24 of the bottom wall 18. The second side wall 42 may be bounded by a second side wall edge 46 disposed along a top portion of second side wall 42, and the second side wall edge 46 may be parallel to and vertically offset from the second side edge 26 of the bottom wall 18. However, the first and second side wall edges 44, 46 may extend in any direction or combination of directions and may be non-linear, segmented, and/or oblique when viewed along a horizontal reference plane.

Again referring to FIG. 1, the upright wall 32 may also include a first transition wall 48 that upwardly extends from the first transition edge 28 of the bottom wall 18 and a second transition wall 50 that upwardly extends from the second transition edge 30 of the bottom wall 18. Each of the first transition wall 48 and the second transition wall 50 may perpendicularly extend from the bottom wall 18, as illustrated in FIG. 1, or may form any angle with the bottom wall 18 that is suitable for a particular application. The first transition wall 48 may follow the contour of the curved first transition edge 28 to extend between the first side wall 40 and the front wall 34. The first transition wall 48 may be bounded by a top transition edge 52 disposed along a top portion of the first transition wall 48, and the top transition edge 52 may be vertically offset from the first transition edge 28. Similarly, the second transition wall 50 may follow the contour of the curved second transition edge 30 to extend between the second side wall 42 and the front wall 34. The second transition wall 50 may be bounded by a top transition edge 54 disposed along a top portion of the second transition wall 50, and the top transition edge 54 may be vertically offset from the second transition edge 30. However, the top transition edges 52, 54 may extend in any direction or combination of directions and may be non-linear, segmented, and/or oblique when viewed along a horizontal reference plane. Each of the first transition wall 48 and the second transition wall 50 may intersect the first and second transition edges 28, 30 of the bottom wall 18 to form a right angle, as illustrated in FIG. 3A, or the intersection may include a radiused portion 36 as discussed above and as illustrated in FIGS. 1 and 3B.

Still referring to FIG. 1, the upright wall 32 may also include a rear wall 56 that intersects the rear edge 22 of the bottom wall 18 and extends between the first side wall 40 and the second side wall 42. The rear wall 56 may have a generally planar shape or may be contoured or partially contoured. For example, in the embodiment illustrated in FIG. 1, the rear wall 56 may have a curved cross-sectional shape such that an external surface 58 of the rear wall 56 is concave. The cross-sectional shape may be semi-circular, semi-elliptical, or otherwise arcuate. The cross-sectional shape may be uniform across the length of the rear wall 56, as illustrated in FIG. 1. However, the shape of the cross-section may also vary along the length of the rear wall 56. The rear wall 56 may intersect the rear edge 22 of the bottom wall 18 to form or approximately form a right angle, as illustrated in FIG. 3A, or the intersection may include a radiused portion 36 as discussed above and as illustrated in FIGS. 1 and 3B.

As illustrated in FIG. 1, the top portion of the rear wall 56 may include a top projection 60 that may extend across the length of the rear wall 56. The top projection 60 may extend across the entire rear wall 56, or a small gap 61 may separate each terminal end of the top projection 60 from a vertical plane passing through an interior surface of each of the first side wall 40 and the second side wall 42, respectively. The top projection may include a rear wall top edge 62 that may be parallel to and vertically offset from the rear edge 22 of the bottom wall 18. However, the rear wall top edge 62 may extend in any direction or combination of directions and may be non-linear, segmented, and/or oblique when viewed along a horizontal reference plane. As illustrated in FIG. 1, the first side wall edge 44, the top transition edges 52 and 54, the front wall top edge 38, and the second side wall edge 46 may all be substantially coplanar, and the plane containing the first side wall edge 44, the top transition edges 52 and 54, the front wall top edge 38, and the second side wall edge 46 may be substantially horizontal. The rear wall top edge 62 may also extend in a horizontal plane, but the vertical distance between the bottom wall 18 and the rear wall top edge 62 may be greater than the vertical distance between the vertical distance between the plane containing the first side wall edge 44, the top transition edges 52 and 54, the front wall top edge 38, and the second side wall edge 46.

Figure 2:
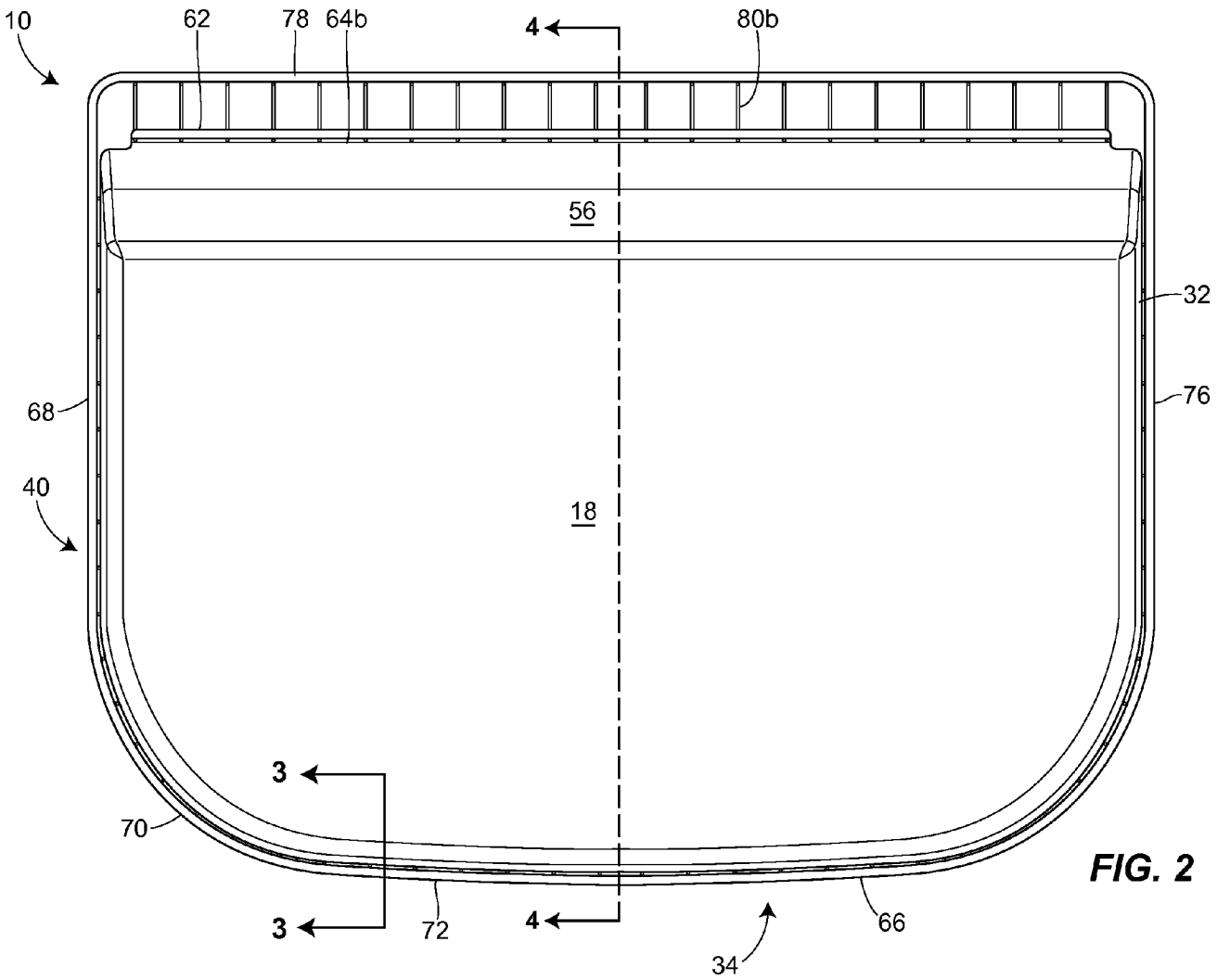
FIG. 2 is a top view of the embodiment of the storage basket illustrated in FIG. 1.
Figure 4:
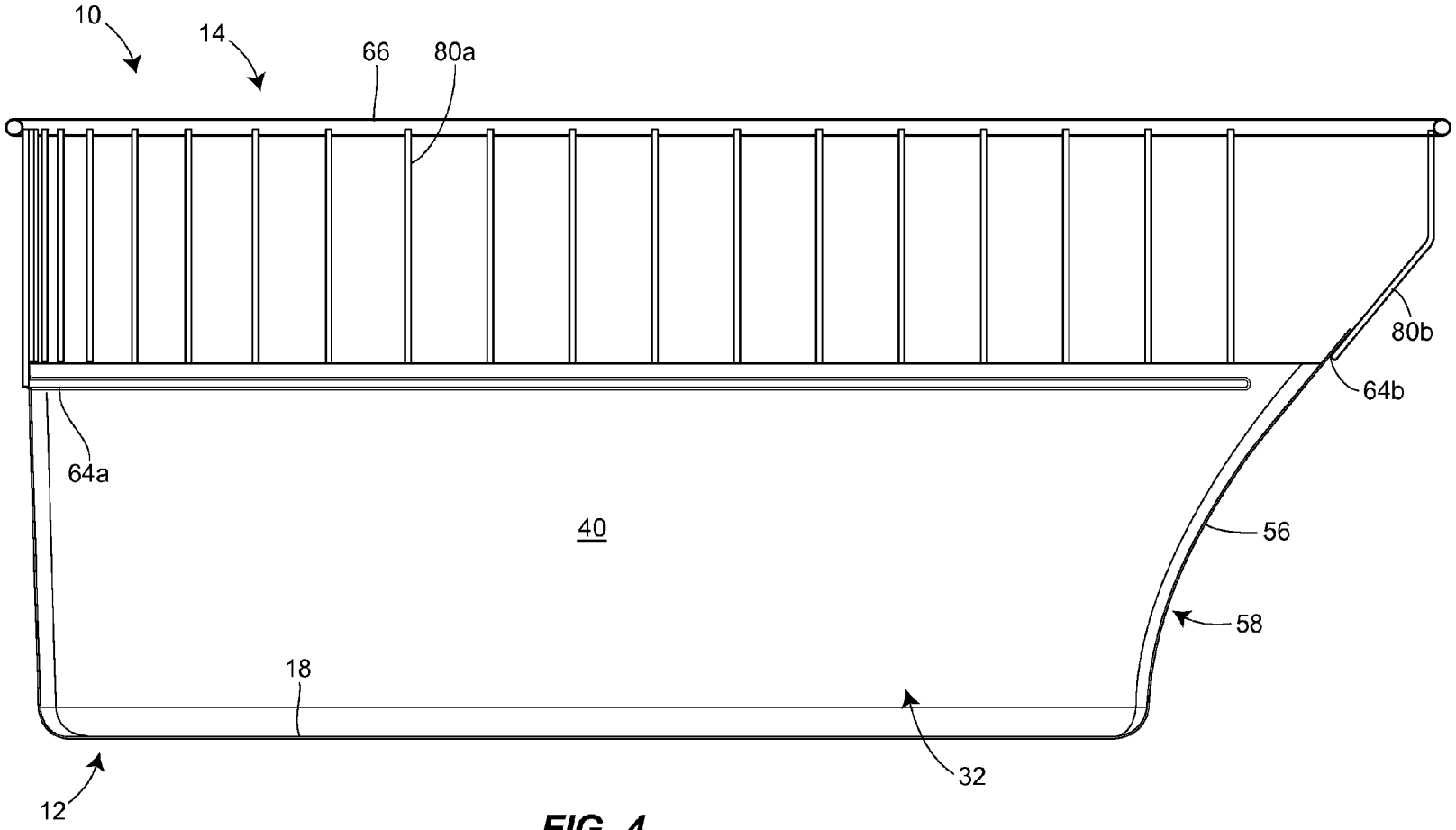
FIG. 4 is a section view of the storage basket, as seen along lines 4-4 of FIG. 2.

Referring to FIGS. 1, 2, and 4, the upright wall 32 may also include one or more ridges 64 that may extend along an exterior surface of at least one of the first side wall 40, the first transition wall 48, the front wall 34, the second transition wall 50, the second side wall 42, and the rear wall 56. For example, in the embodiment illustrated in FIG. 1, a first ridge 64*a* extends along an exterior surface of the first side wall 40, the first transition wall 48, the front wall 34, the second transition wall 50, and the second side wall 42. In this embodiment, the first ridge 64*a* horizontally extends immediately adjacent to the first side wall edge 44, the top transition edges 52 and 54, the front wall top edge 38, and the second side wall edge 46. In the embodiment of FIG. 1, a second ridge 64*b* extends across the external surface 58 of the rear wall 56 such that the second ridge 64*b* horizontally extends immediately adjacent to the rear wall top edge 62. In this embodiment, the first and second ridges 64*a*, 64*b* are C-shaped protrusions that are formed by a stamping operation.

In further embodiments, the one or more ridges 64 may be offset any distance from the first side wall edge 44, the top transition edges 52 and 54, the front wall top edge 38, and the second side wall edge 46, and/or the rear wall top edge 62. For example, a portion of the ridge 64 may contact the first side wall edge 44, the top transition edges 52 and 54, the front wall top edge 38, and the second side wall edge 46. Instead of a single first ridge 64 extending across the first side wall 40, the first transition wall 48, the front wall 34, second transition wall 50, and the second side wall 42, a plurality of ridges 64 may horizontally extend immediately adjacent to, or offset a suitable distance from, the first side wall edge 44, the top transition edges 52 and 54, the front wall top edge 38, and the second side wall edge 46. A plurality of ridges 64 may similarly extend across the rear wall 56. In further embodiments, a single ridge 64 may extend along the first transition wall 48, the front wall 34, the second transition wall 50, the second side wall 42, and the rear wall 56 such that ridge extends around the entire upright wall 32. In further embodiments, the one or more ridge 64 may have any cross sectional shape, such as that of a rectangle or a wedge, for example. The one or more ridge 64 may be integrally formed with the upright wall 32 or may be secured to one or more portions of the upright wall 32.

Configured as illustrated in FIG. 1, the single-material first portion 12, which is comprised of the bottom wall 18 and the upright wall 32, may be substantially non-porous and imperforate. That is, neither the bottom wall 18 nor the upright wall 32 has any significant openings, perforations, or apertures that allow any solid particles, liquids, and/or gas (e.g., airflow) to flow through the surfaces that comprise the bottom wall 18 and the upright wall 32. The first portion 12 may be formed as a unitary part, or may be assembled from a plurality of components. The first portion 12 may be formed from any suitable material or combination of materials. For example, the first portion 12 may be formed from a metal, such as stainless steel, aluminum, galvanized steel, or other metal or metal alloy. The metal or metal alloy may be formed or cut into a sheet by one or more stamping operations, and the sheet may be formed into the first portion 12 by one or more bending operations. Alternatively, the single-material first portion 12 may be made from a plastic material, such as a polypropylene, an ABS, or a polycarbonate, and formed in an injection molding operation, for example. The first portion 12 may also be formed by, or partially formed by, glass. Although the first portion 12 is illustrated in FIGS. 1 and 3-6 as opaque or non-transparent, the material (e.g., glass or plastic material) comprising the first portion 12 may be transparent or semi-transparent. Alternatively, the first portion 12 may include portions that are non-transparent, transparent, and/or semi-transparent.

As illustrated in FIG. 1, the storage basket 10 may include a single-material second portion 14 coupled to the first portion 12. More specifically, the second portion 14 may include a top rail 66, and the top rail 66 may include a plurality of linear and/or curved segments. For example, as illustrated in FIG. 1, when the second portion 14 is coupled to the first portion 12 and is viewed perpendicular to the horizontal bottom wall 18 of the first portion 12, each segment of the top rail 66 may generally correspond in shape and orientation to each of the edges of the bottom wall 18. Specifically, a first side segment 44 may extend parallel to and slightly outward from the first side edge 24 of the bottom wall 18, a first transition segment 70 may along extend along and slightly outward from the first transition edge 28 of the bottom wall 18, a front segment 72 may extend parallel to and slightly outward from the front edge 20 of the bottom wall 18, a second transition segment 74 may along extend along and slightly outward from the second transition edge 30 of the bottom wall 18, and a second side segment 76 may extend parallel to and slightly outward from the second side edge 26 of the bottom wall 18. In addition, a rear segment 78 may extend parallel to outward from both the front edge 20 of the bottom wall 18 and the rear wall top edge 62 viewed perpendicular to the horizontal bottom wall 18. As illustrated in FIG. 1, each of the segments 68, 70, 72, 74, 76, 78 may be formed in the same plane such that the top rail 66 is contained in a horizontal plane that is parallel to the plane formed by the bottom wall 18. However, the segments 68, 70, 72, 74, 76, 78 comprising the top rail 66 may all be contained in a non-horizontal plane, or may not be contained in the same plane at all. The top rail 66 may have a uniform cross-sectional shape along the entire length of the top rail 66, and the cross-sectional shape may be circular, as illustrated in FIG. 1. However, the top rail 66 may have any suitable cross-sectional shape, such as that of an oval, a semi-circle, or a rectangle or other polygon, for example. The top rail 66 may be made from any single material, such as rolled or drawn steel wire, injection molded plastic, or glass, for example. The top rail 66 may be formed by a single rod that is shaped into the segments described above in a series or bending operations, and the free ends of the shaped rod may be welded together to eliminate a gap along the length of the top rail 66. Alternatively, the top rail 66 may be formed of several segments that are welded together. Moreover, the top rail 66 may be comprised of two or more segments such that a gap (not shown) separates adjacent segments.

As illustrated in FIGS. 1, 2, and 4, the top rail 66 of the single-material second portion 14 may be coupled to the single-material first portion 12 by one or more rail supports 80. As illustrated in FIG. 1, the rail supports 80 may include a plurality of linear rail supports 80*a* that vertically extend between and are coupled to the upright wall 32 and the top rail 66. More specifically, each of the plurality of linear rail supports 80*a* are coupled to an inwardly disposed surface of the top rail 66 and an outwardly disposed surface of the first ridge 64*a* that extends across the first side wall 40, the first transition wall 48, the front wall 34, second transition wall 50, and the second side wall 42. In addition, a plurality of angled rail supports 80*b* may extend between the rear segment 78 of the top rail 66 and the second ridge 64*b* that extends across the external surface 58 of the rear wall 56. Each of the angled rail supports 80*b* may have a vertical portion that is coupled to and extends vertically downward from an inwardly disposed surface of the rear segment 78, and each of the angled rail supports 80*b* may have an angled portion that extends obliquely from the vertical portion towards an outwardly disposed surface of the first ridge 64*a*. Each of the linear rail supports 80*a* and/or angled rail supports 80*b* may be uniformly spaced, or may have non-uniform spacing. The spaces between adjacent rail supports 80, such as the linear rail supports 80*a* and/or angled rail supports 80*b*, may define or partially define the plurality of perforations 16. Each of the plurality of perforations 16 may be further defined by the top rail 66 and a top edge portion of the upright wall 32. For example, one of the plurality of perforations 16 of the embodiment of FIG. 1 may be bounded by adjacent linear rail supports 80*a*, a bottom portion of the front segment 72 of the top rail 66, and the front wall top edge 38 of the upright wall 32. However, any aperture, opening, or window formed in the second portion 14 and adapted to allow airflow through the single-material second portion 14 or a portion of the second portion 14 may be a perforation 16.

Each of the linear rail supports 80*a* and/or angled rail supports 80*b* may have a circular cross-sectional shape, as illustrated in FIG. 1. However, the linear rail supports 80*a* and/or angled rail supports 80*b* may have any suitable cross-sectional shape, such as that of an oval, a semi-circle, or a polygon, for example. The linear rail supports 80*a* and/or angled rail supports 80*b* may be made from any material, such as rolled or drawn steel wire, injection molded plastic, or glass, for example. The rail supports 80, such as the linear rail supports 80*a* and/or angled rail supports 80*b*, may be coupled to the top rail 66 and the upright wall 32 by any method known in the art. For example, if formed of metal, each of the linear rail supports 80*a* may be welded to an inwardly disposed surface of the top rail 66 and an outwardly disposed surface of the first ridge 64*a* and each of the angled rail supports 80*b* may be welded to an inwardly disposed portion of the rear segment 78 of the top rail 66 and the second ridge 64*b* of the rear wall 56. As used herein, the term "welding" may include the welding of metal parts as well as the welding of plastic parts by such processes as ultrasonic welding. Instead of welding, the linear rail supports 80*a* and/or angled rail supports 80*b* may be coupled to the top rail 66 and/or the first ridge 64*a* and second ridge 64*b*, respectively, by an adhesive or a mechanical coupling, such as a bolt/rivet and eyelet, for example. The rail supports 80 may also be adapted to be received into slots formed in the upright wall 32, and the rail supports 80 may have tabs that may lock into a corresponding slot, and the tabs may be permanently locked into a corresponding slot. However, the tabs may be coupled or otherwise locked into a corresponding slot such that the second portion 14 can be removed from the first portion 12 for cleaning purposes, for example.

Instead of the linear rail supports 80*a* and/or angled rail supports 80*b*, the rail supports 80 may be wires that may form a grid pattern, and the grid pattern may include both one or more horizontal and one or more vertical rail support 80 wires. The spaces between the vertical and horizontal rail support 80 wires may form the plurality of apertures 16. However, the grid pattern may have an angled orientation such that an X-shaped grid is formed.

If desired, the storage basket 10 may be coupled to an interior portion of a refrigerator or freezer such that the storage basket 10 can be displaced from a first position (such as an open position) to a second portion (such as a closed position). Such displacement can be accomplished by any means known in the art, such as by roller tracks, ball bearing slides, mounting brackets, dividers, or other hardware. This ability to displace the storage basket 10 provides improved features for the user, such as improved accessibility to food and/or other materials contained in the storage basket 10 as well as an improved ability to organize the food and/or other materials contained in the storage basket 10. Accordingly, the first portion 12 and/or the second portion 14 of the storage basket 10 (or any embodiment of the storage basket), regardless of what material is used, may be readily modified (as known) to accommodate such roller tracks, slides, etc.

As configured, the imperforate single-material first portion 12 of the storage basket 10 of the present disclosure prevents food particles, food seepage, and the like from falling onto the refrigerator liner. In addition, the imperforate first portion 12 is also easy to clean if a spill occurs. The single-material second portion 14 having the plurality of perforations 16, however, allows for air flow over and around materials contained in the storage basket. The plurality of perforations 16 also reduces the amount of material used for the storage basket while providing visibility into the interior of the first portion 12. Moreover, in embodiments of the storage basket 10 having a second portion 14 that is removably coupled to the first portion 12, cleaning is further simplified. In addition, improved strength and rigidity of the storage basket 10, as well as a reduction in weight, may be realized when compared to solely plastic baskets.

Figure 5:
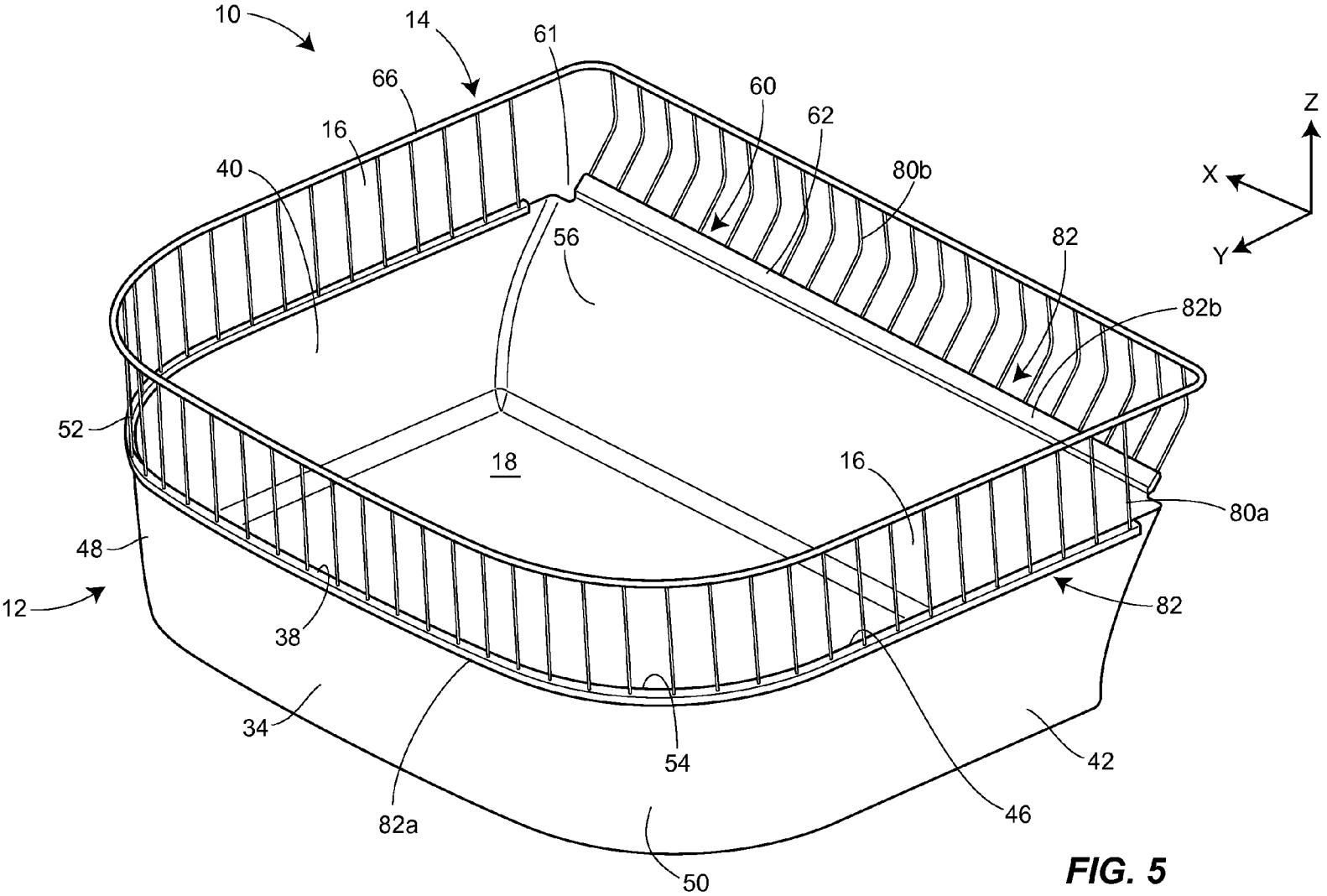
FIG. 5 is a perspective view of a further embodiment of the storage basket.
Figure 6:
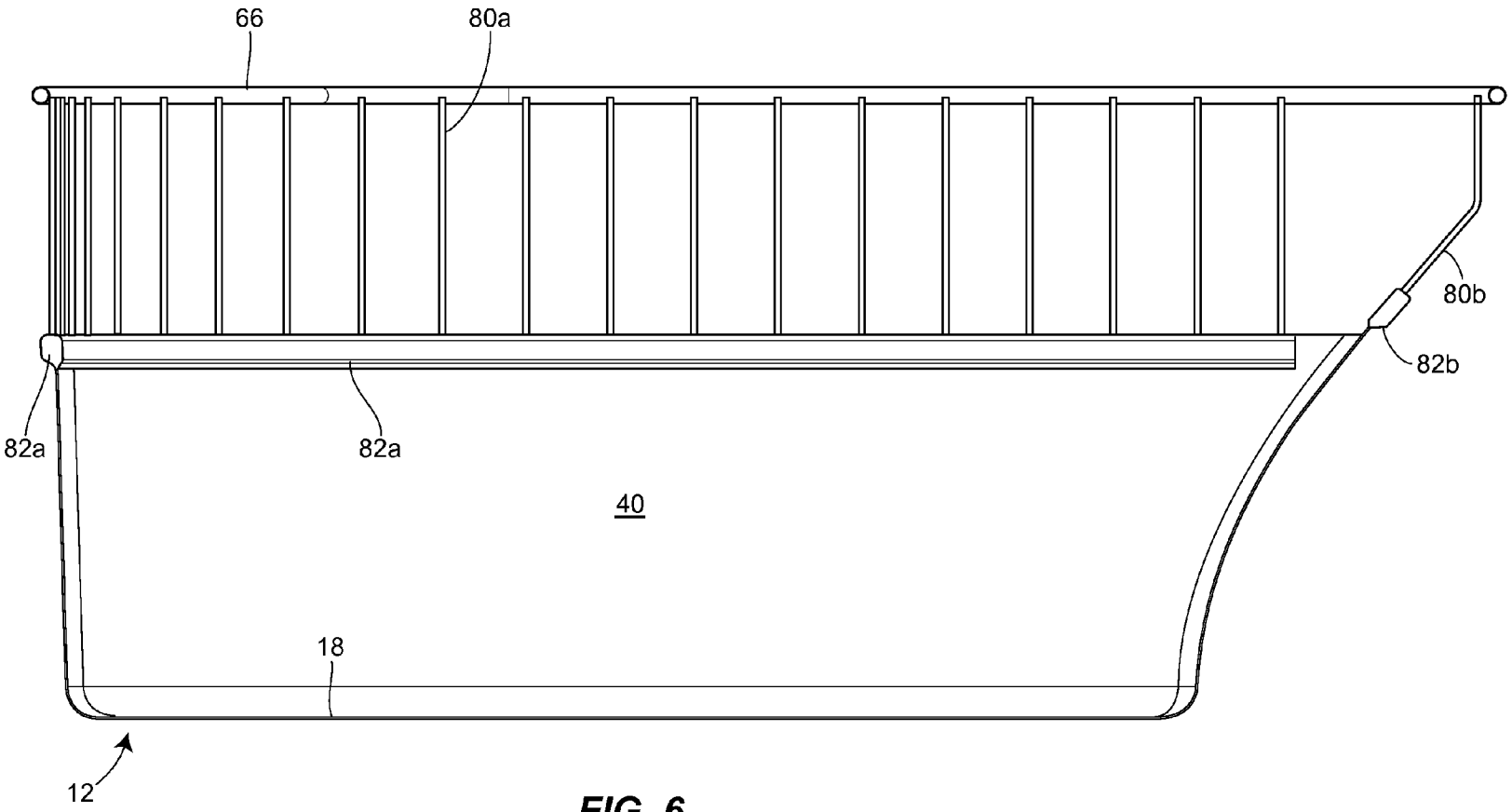
FIG. 6 is a section view of the storage basket illustrated in FIG. 5, as seen along lines similar to lines 4-4 of FIG. 2.

In a further embodiment of the storage basket 10 illustrated in FIGS. 5 and 6, the upright wall does not have ridge 64. Instead, a top protrusion 82 may extend along a top portion of at least one of the first side wall 40, the first transition wall 48, the front wall 34, the second transition wall 50, the second side wall 42, and the rear wall 56. For example, in the embodiment illustrated in FIGS. 5 and 6, a first top protrusion 82*a* extends along a top portion of the first side wall 40, the first transition wall 48, the front wall 34, the second transition wall 50, and the second side wall 42. In this embodiment, the first top protrusion 82*a* horizontally extends along the first side wall edge 44, the top transition edges 52 and 54, the front wall top edge 38, and the second side wall edge 46. In the embodiment of FIGS. 5 and 6, a second top protrusion 82*b* extends across a top portion of the rear wall 56 such that the second top protrusion 82*b* horizontally extends along the rear wall top edge 62. The first and second top protrusions 82*a*, 82*b* can have any suitable cross-sectional shape, such as that of a rectangle, a square, a polygon, an oval, a circle, or any combination thereof. In this embodiment, the first portion 12 may be formed by a plastic material, and one or more slots or other apertures may be formed in the first top protrusion 82*a* and/or the second top protrusion 82*b*. Such slots or apertures may be adapted to receive an end portion of one or more linear rail supports 80*a* or one or more angled rail supports 80*b*.

Alternatively, the end portion of one or more linear rail supports 80*a* or one or more angled rail supports 80*b* may be insert molded into an injection molded plastic single-material first portion 12. The end portion of one or more linear rail supports 80*a* or one or more angled rail supports 80*b* may have tabs that may lock into a corresponding slot or aperture in first top protrusion 82*a* and/or the second top protrusion 82*b*, and the tabs may be permanently locked into a corresponding slot or aperture. However, the tabs may be coupled or otherwise locked into a corresponding slot such that the single-material second portion 14 can be removed from the first portion 12 for cleaning purposes, for example. Alternatively, the end portion of one or more linear rail supports 80*a* or one or more angled rail supports 80*b* may be insert molded into an injection molded plastic first portion 12.

Referring to FIGS. 7-11, a further embodiment of the storage basket 100 may include a single-material first portion 112 and a single-material second portion 114 coupled to the first portion 112, wherein the second portion 114 includes a plurality of perforations 116.

Figure 7:
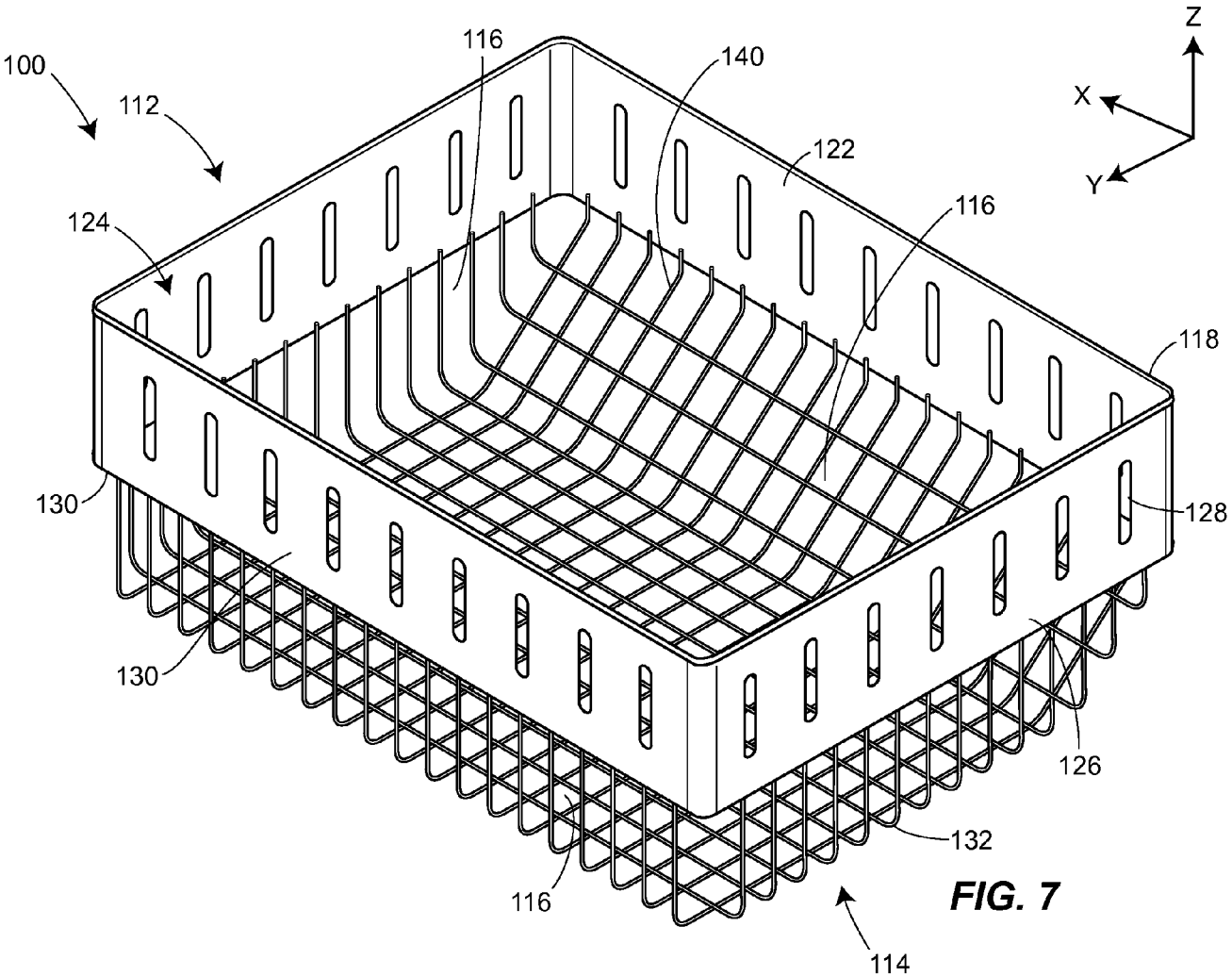
FIG. 7 is a perspective view of a further embodiment of the storage basket.

More specifically, the first portion 112 may be comprised of an upright wall 118 that may extend in a substantially vertical direction. As previously explained, the term "vertical" indicates a direction that is substantially normal to the X-Y plane (i.e., the direction of the Z axis) of the reference coordinate system illustrated in FIG. 7, and the term "horizontal" indicates a direction that is substantially coplanar with or substantially parallel to the X-Y plane of the reference coordinate system. The upright wall 118 may include a front wall 120 that is substantially planar. The upright wall 122 may also include a rear wall 122 may be substantially planar, and the rear wall 122 may be parallel to and offset from the front wall 120. The upright wall 118 may be laterally defined by a first side wall 124 and a second side wall 126, and each of the first side wall 124 and the second side wall 126 may be substantially planar. The first side wall 124 may extend between a first end portion of the front wall 120 and a first end portion of the rear wall 122 and the second side wall 126 may extend between a second end portion of the front wall 120 and a second end portion of the rear wall 122 such that the second side wall 126 is parallel to and offset from the first side wall 124. In this configuration, both the first side wall 124 and the second side wall 126 extend orthogonally from the front wall 120 and the rear wall 122, and a bottom perimeter edge may be formed by the bottom edges of each of the front wall 120, the rear wall 122, the first side wall 124, and the second side wall 126. Also in this configuration, the walls 120, 122, 124, 126 may intersect to form right angles, or, as shown in FIG. 7, rounded edges. In further embodiments, the front wall 120 and the rear wall 122 may not be parallel, an/or the first side wall 124 and the second side wall 126 may not be parallel. In addition, any or all of the front wall 120, the rear wall 122, the first side wall 124, and the second side wall 126 may not be disposed orthogonal to a horizontal plane. In additional embodiments, one or more additional walls may be included in the upright wall 118 instead of or addition to the front wall 120, the rear wall 122, the first side wall 124, and the second side wall 126 illustrated in FIG. 7. It is also contemplated that any or all of the front wall 120, the rear wall 122, the first side wall 124, and the second side wall 126 (or any additional walls) may be curved or contoured instead of planar, or may be partially curved and partially planar.

Figure 9:
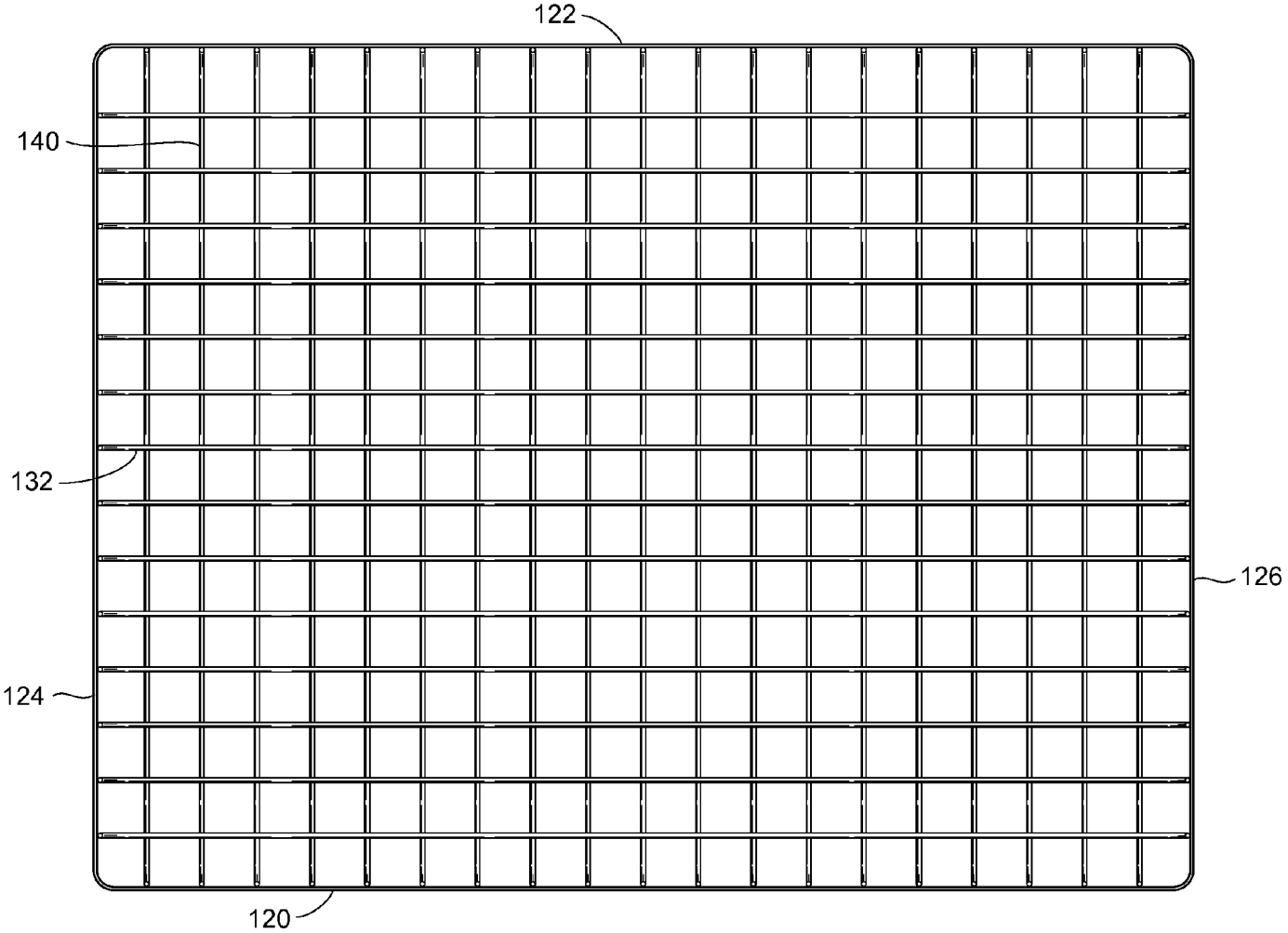
FIG. 9 is a top view of the embodiment of the storage basket illustrated in FIG. 7.
Figure 10:
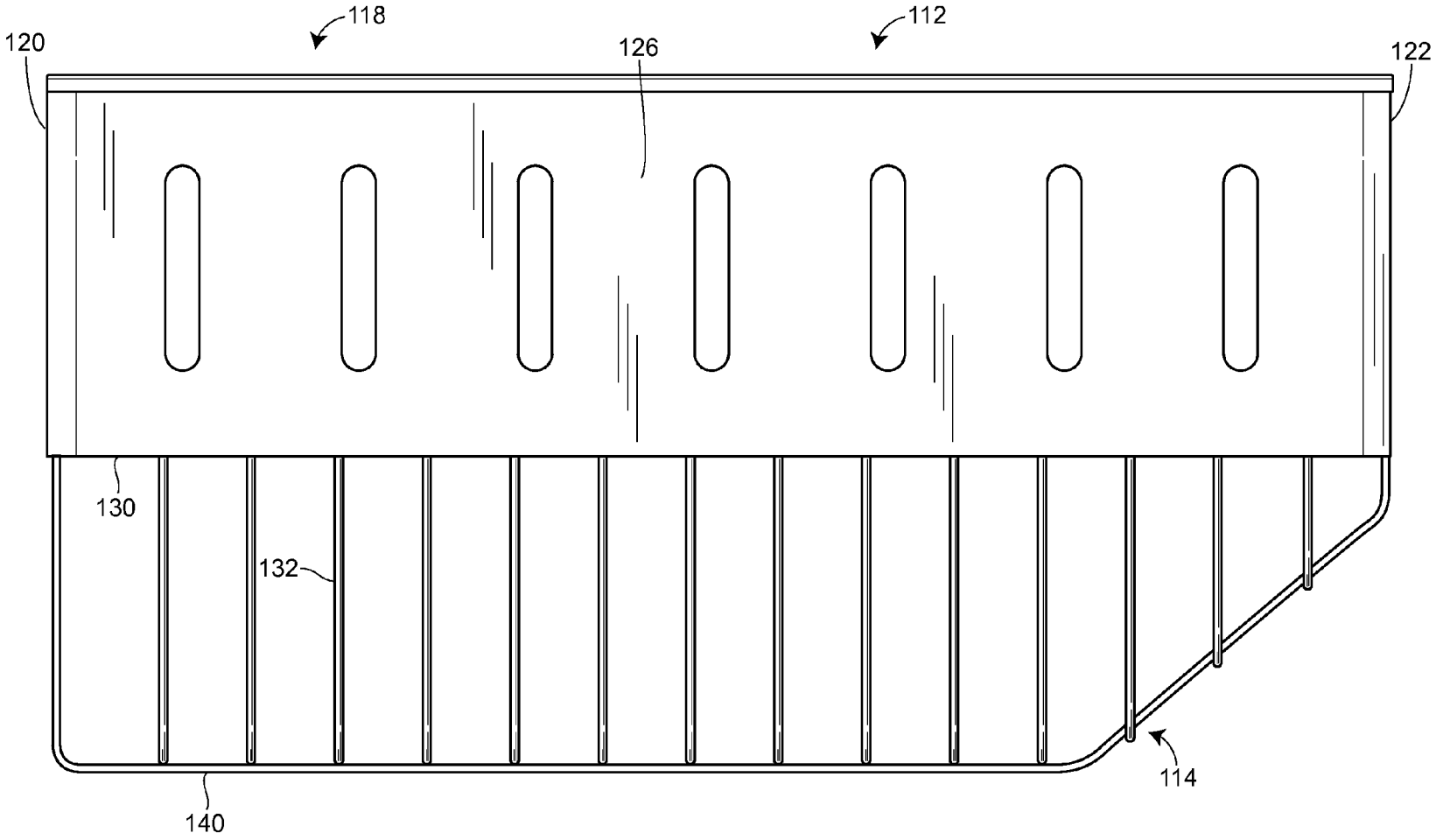
FIG. 10 is a side view of the embodiment of the storage basket illustrated in FIG. 7.
Figure 11:
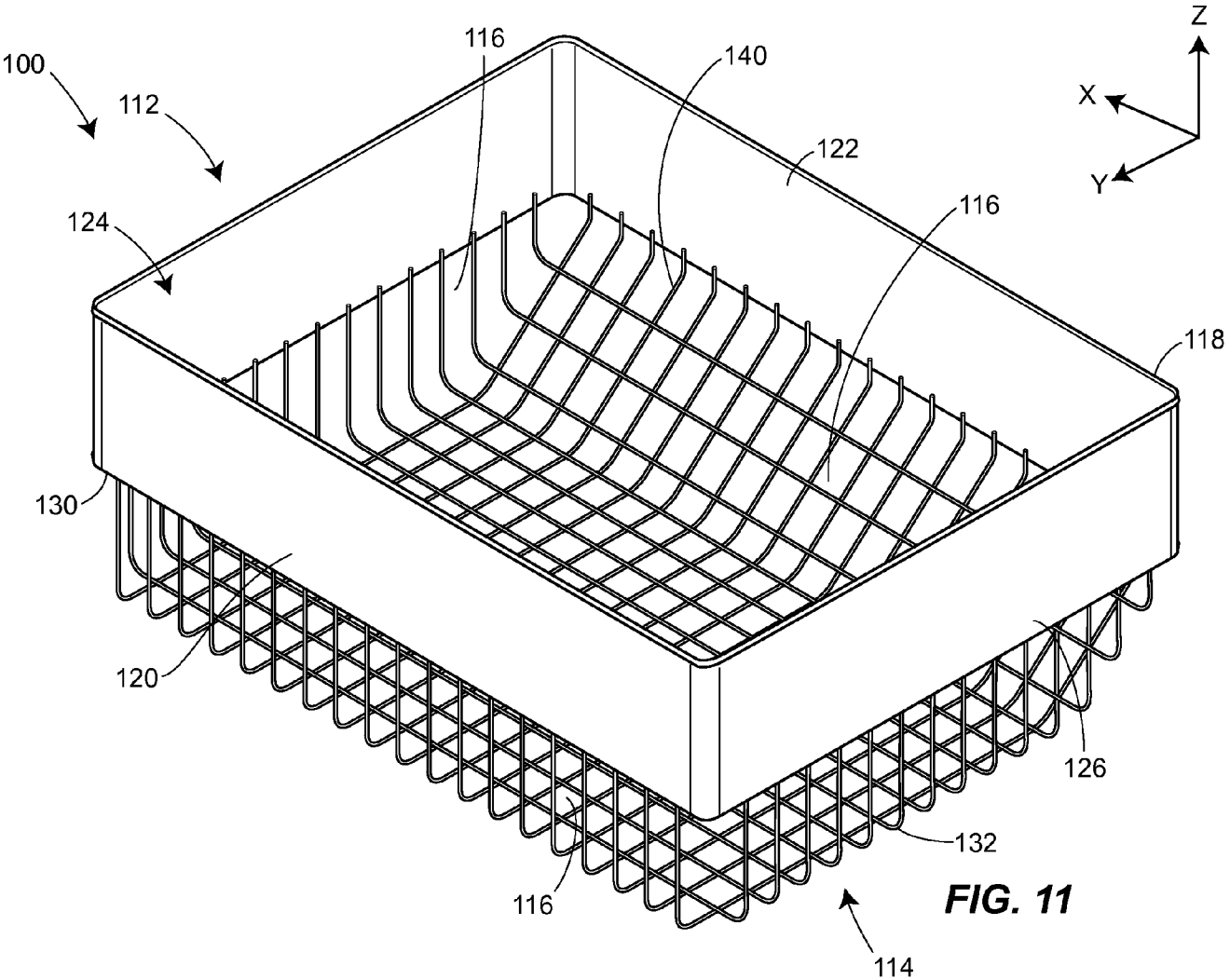
FIG. 11 is a perspective view of a further embodiment of the storage basket.

In an embodiment of the storage basket 100, each of the front wall 120, the rear wall 122, the first side wall 124, and the second side wall 126 of the first portion 112 may be substantially non-porous and imperforate, as illustrated in FIG. 11. That is, none of the front wall 120, the rear wall 122, the first side wall 124, and the second side wall 126 may have any significant openings, perforations, or apertures that allow any solid particles, liquids, or gas to flow through the surfaces that comprise the first portion 112. However, as illustrated in FIGS. 7, 9, and 10, the front wall 120, the rear wall 122, the first side wall 124, and the second side wall 126 may each include one or more slots or other apertures, such as the plurality of vertical slots 128, to facilitate a minimal airflow and allow some visibility into the top portion of the storage basket's contents. The front wall 120, the rear wall 122, the first side wall 124, and the second side wall 126 may be formed from a single sheet that has been stamped and formed in separate manufacturing steps. Conversely, one or more of the front wall 120, the rear wall 122, the first side wall 124, and the second side wall 126 may be formed as a separate component, and the separate components may be coupled by any means known in the art to form the upright wall 118. The upright wall 118 may be formed from any suitable material or combination of materials. For example, the upright wall 118 may be formed from a metal, such as stainless steel, aluminum, galvanized steel, or other metal or metal or metal alloy, that is formed in one or more stamping operations. Alternatively, the upright wall 118 may be made from a plastic material, such as a polypropylene, and ABS, or a polycarbonate, and formed in an injection molding operation, for example. The upright wall 118 may also be formed, or partially formed, by glass. Although the upright wall 118 is illustrated in FIGS. 7, 10, and 11 as opaque or non-transparent, the material (e.g., glass or plastic material) comprising the upright wall 118 may be transparent or semi-transparent. Alternatively, the upright wall 118 may include portions that are non-transparent, transparent, and/or semi-transparent.

Figure 8A:
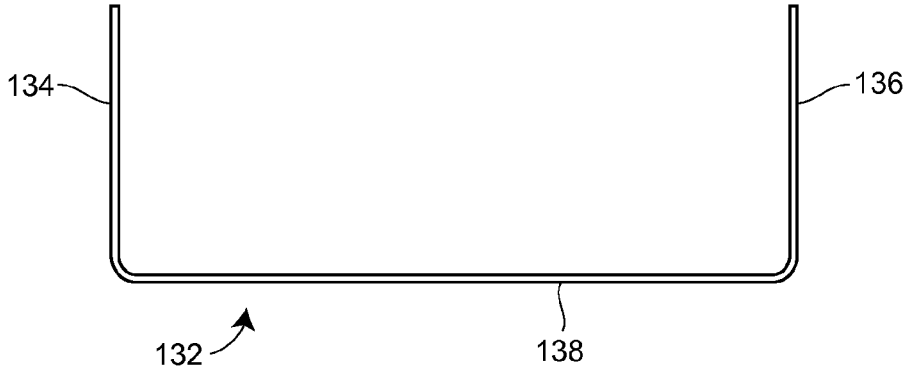
FIG. 8A is a front view of a first support member of the second portion of the embodiment of the storage basket illustrated in FIG. 7.

As illustrated in FIG. 7, the storage basket 100 also includes a second portion 114 having a plurality of perforations 116. The second portion 114 may comprise a wire grid that is secured to the upright wall 118. The wire grid may be comprised of a plurality of first support members 132. As illustrated in FIG. 8A, each of the first support members 132 may include a first side portion 134 coupled to and extending vertically from a lower portion of the first side wall 124 adjacent to the bottom perimeter edge 130. Each of the first support members 132 may also include a second side portion 136 coupled to and extending vertically from a lower portion of the second side wall 126 adjacent to the bottom perimeter edge 130, and the first side portion 134 and the second side portion 136 may have the same length. A bottom portion 138 may horizontally extend between the first side portion 134 and the second side portion 136. A plurality of uniformly sized first support members 132 may be disposed along the first and side wall 124, 126, and each of the plurality of first support members 132 may be uniformly spaced from adjacent first support members 132. However, as the plurality of first support members 132 approaches the rear wall 122, the first and second side portions 134, 136 may become gradually shorter, as illustrated in FIG. 7.

In further embodiments, the first side portion 134 and/or the second side portion 136 of the first support member 132 may be angled relative to a vertical reference axis, or may be curved, partially curved, and/or partially angled relative to a vertical reference axis. Similarly, the bottom portion 138 may be curved, partially curved, angled, and/or partially angled relative to a horizontal reference axis. The first support member 132 may have any suitable cross-sectional shape or combination of shapes. For example, the first support member 132 may have a circular cross-sectional shape, or may have the cross-sectional shape of a thin rectangle, a square, an oval, or a polygon, for example.

Figure 8B:
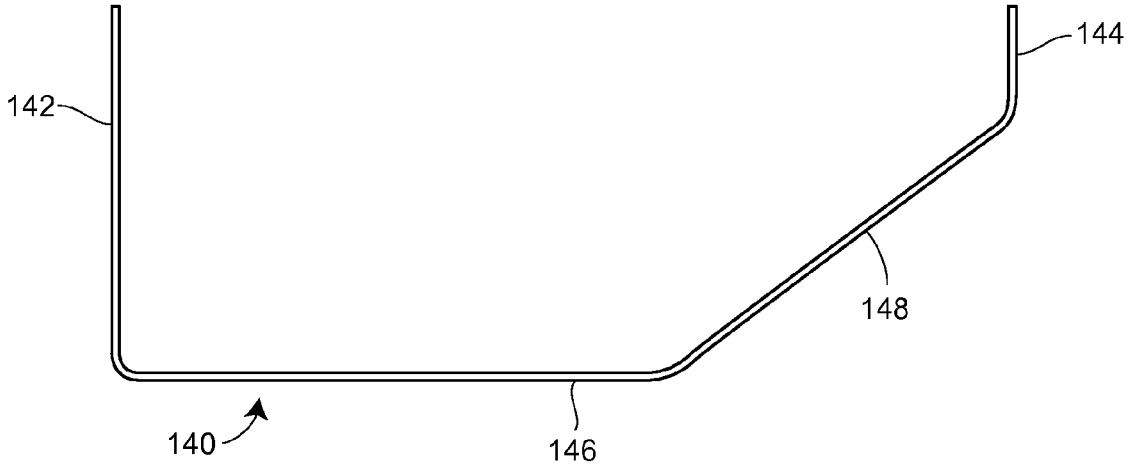
FIG. 8B is a front view of a second support member of the second portion of the embodiment of the storage basket illustrated in FIG. 7.

Referring to FIG. 7, the wire grid of the second portion 114 may also be comprised of a plurality of second support members 140. As illustrated in FIG. 8B, each of the second support members 140 may include a first side portion 142 coupled to and extending vertically from a lower portion of the front wall 120 adjacent to the bottom perimeter edge 130. Each of the second support members 140 may also include a second side portion 144 coupled to and extending vertically from a lower portion of the rear wall 122 adjacent to the bottom perimeter edge 130, and the first side portion 142 may have a longer length than the second side portion 144. A bottom portion 146 may horizontally extend from the first side portion 134 towards the second side portion 136, and the bottom portion may terminate before reaching a point immediately below the rear wall 122 (when viewed along the Z axis of the reference coordinate system). As illustrated in FIGS. 7 and 8B, an oblique portion 148 may obliquely extend between the end portion of the bottom portion 146 and the end portion of the second side portion 144. The oblique portion 148 may be angled such that a portion of the oblique portion 148 of each of the second support members 140 contacts a portion of the bottom portion 138 of each of the first support members 132 having first and second side portions 134, 136 that become gradually shorter as the first support members 132 approach the rear wall 122. In an alternate embodiment, the second support member 140 may not have an oblique portion 148, and may instead have a first side portion 142 and a second side portion 144 that have a substantially equal length. As illustrated in FIG. 7, the plurality of second support members 140 may be uniformly spaced from adjacent second support members 140, and each of the second support members 140 may be disposed in a plane that is orthogonal to a plane that contains the first support members 132.

In further embodiments, the first side portion 142 and/or the second side portion 144 of the second support member 140 may be angled relative to a vertical reference axis, or may be curved, partially curved, and/or partially angled relative to a vertical reference axis. Similarly, the bottom portion 146 may be curved, partially curved, angled, and/or partially angled relative to a horizontal reference axis. The second support member 140 may have any suitable cross-sectional shape or combination of shapes. For example, the second support member 140 may have circular cross-sectional shape, or may have the cross-sectional shape of a thin rectangle, a square, an oval, or a polygon, for example.

As previously, stated the first support members 132 and the second support members 140 may each be secured to lower portions of the upright wall 118 adjacent to the bottom perimeter edge 130. The first support members 132 and the second support members 140 may be secured to the upright wall 118 by any method known in the art, such as by welding, by use of an adhesive, and/or by use of mechanical fasteners, for example. For example, an upper portion of the first side portion 134 of each of the first support members 132 may be welded to an inside surface of the first side wall 124 adjacent to the bottom perimeter edge 130, and an upper portion of the second side portion 136 of each of the first support members 132 may be welded to an inside surface of the second side wall 126 adjacent to the bottom perimeter edge 130. In addition, an upper portion of the first side portion 142 of each of the second support members 140 may be welded to an inside surface of the front wall 120 adjacent to the bottom perimeter edge 130, and an upper portion of the second side portion 144 of each of the second support members 140 may be welded to an inside surface of the rear wall 122 adjacent to the bottom perimeter edge 130.

Instead of being coupled directly to the inside surface of each of the front wall 120, the rear wall 122, the first side wall 124, and the second side wall 126, the first side portions 134, 142 and second side portions 136, 144 may be coupled to a ridge 64 in the manner previously described. In addition, the first side portions 134, 142 and second side portions 136, 144 of the first support member 132 and the second support member 140 may also be adapted to be received into slots formed in a lower portion of the upright wall 118, and the first side portions 134, 142 and second side portions 136, 144 may have tabs that may lock into a corresponding slot, and the tabs may be removable from or permanently locked into a corresponding slot. Alternatively, the first side portions 134, 142 and second side portions 136, 144 may be inserted molded into the upright wall 118 if the upright wall 118 is made of plastic and is formed using an injection molding process. For additional support, the bottom portion 138 of each first support member 132 may be coupled to the bottom portion 146 or the oblique portion 148 of each of the second support members 140. For example, a surface of the bottom portion 138 of each first support member 132 may be welded to a surface of the bottom portion 146 or the oblique portion 148 at a point where the first support member 132 intersects or is otherwise adjacent to the second support member 140.

In the embodiment of the storage basket 100 illustrated in FIG. 7, each of the spaces between adjacent components of the wire grid of the second portion 114, or of one or more of the components of the wire grid and the bottom perimeter edge 130 of the upright wall 118, may form a perforation 116. For example, two adjacent first support members 132 and two adjacent second support members 140 may collectively form a perforation 116. As an additional example, the bottom perimeter edge 130 of the front wall 120, adjacent second support members 140, and the nearest first support member 132 to the front wall 120 may collectively define a perforation 116. The plurality of perforations 116 allows for air flow over and around materials contained in the storage basket. The plurality of perforations 116 also reduces the amount of material used for the storage basket, thereby reducing the weight, while providing visibility into the interior of the second portion 114. Moreover, the plurality of perforations 116 may allow drainage, such as water from melting ice or food liquids, to fall from the perforations 116 and not pool within the single-material second portion 114.

In further embodiments, the first side portion 134 and second side portion 138 of the first support member 132 and the first side portion 144 and second side portion 144 of the second support member 132 may be coupled to an imperforate bottom wall (not shown). The bottom wall may be formed from any suitable material or combination of materials. For example, the bottom wall may be formed from a metal, such as stainless steel, aluminum, galvanized steel, or other metal or metal or metal alloy, that is formed in one or more stamping operations. Alternatively, the bottom wall may be made from a plastic material, such as a polypropylene or a polycarbonate, in an injection molding operation, for example. Or, the bottom wall may be formed, at least in part, of glass.

In addition to the advantages described above, the first portion 112 of the storage basket 100 partially, or completely, hides or obscures the materials contained in the storage basket 100, thereby creating a cleaner and more aesthetically pleasing refrigerator/freezer interior when the storage basket 100 is in use.

While various embodiments have been described above, this disclosure is not intended to be limited thereto. Variations can be made to the disclosed embodiments that are still within the scope of the appended claims.

What is claimed:

1. A storage basket used for storing and displaying food products and packages in a refrigerator or freezer unit, the storage basket comprising:

a first portion including an upright wall, the upright wall including sheet material defining a planar front wall, a planar rear wall, a planar first side wall, and a planar second side wall, wherein one or more of the front wall, the rear wall, the first side wall, and the second side wall includes one or more slots in the sheet material to facilitate a minimal airflow and allow some visibility into the first portion of the storage basket, wherein an entire cross-sectional shape of each of the planar front wall, the planar rear wall, the planar first side wall, and the planar second side wall extends from a first end to a second end along a linear axis such that a top portion of the cross-sectional shape adiacent to a top perimeter edge of the upright wall is not curved;

a second portion coupled to and extending entirely below the upright wall of the first portion, wherein the second portion comprises a wire grid secured to a bottom perimeter edge of the upright wall such that the wire grid and the upright wall are not a single-piece member, wherein the wire grid defines a plurality of perforations that cooperate to permit solid particles, liquids, and/or gases to flow through the second portion, thereby allowing visibility or airflow around and about materials contained in the storage basket.

2. The storage basket of claim 1, wherein the second portion is coupled to the first portion adjacent to a bottom perimeter edge of the upright wall.

3. The storage basket of claim 1, wherein the wire grid of the second portion comprises:

a plurality of first support members each having vertical portions coupled to the upright wall;

a plurality of second support members each having vertical portions coupled to the upright wall.

4. The storage basket of claim 3, wherein the first support member and the second support member are made from a metal wire, and the upright wall is formed from a single sheet of metal.

5. The storage basket of claim 3, wherein the first support member and the second support member are made from a metal wire, and the upright wall is formed from one of a plastic material or a glass material.

6. The storage basket of claim 3, wherein the first support member, the second support member, and the upright wall are each formed from one of a plastic material or a glass material.

7. The storage basket of claim 1, wherein each of the front wall, the rear wall, the first side wall, and the second side wall includes a plurality of slots in the sheet material.

8. The storage basket of claim 1, wherein the second portion includes at least one side portion that is in plane parallel to the first portion, and a bottom portion that is in a plane perpendicular to the first portion.

9. The storage basket of claim 1, wherein the linear axis extends in a vertical direction.

10. A storage basket used for storing and displaying food products and packages in a refrigerator or freezer unit, the storage basket comprising:

a first portion formed entirely of sheet material and including an upright wall, the upright wall including a planar front wall, a planar rear wall, a planar first side wall, and a planar second side wall, wherein one or more of the front wall, the rear wall, the first side wall, and the second side wall includes one or more slots in the sheet material to facilitate a minimal airflow and allow some visibility into the first portion of the storage basket, wherein an entire cross-sectional shape of each of the planar front wall, the planar rear wall, the planar first side wall, and the planar second side wall extends from a first end to a second end along a linear axis such that a top portion of the cross-sectional shape adjacent to a top perimeter edge of the upright wall is not curved;

a second portion coupled to and extending entirely below the upright wall of the first portion, wherein the second portion comprises a wire grid secured to a bottom perimeter edge of the upright wall such that the wire grid and the upright wall are not a single-piece member, wherein the wire grid defines a plurality of perforations that cooperate to permit solid particles, liquids, and/or gases to flow through the second portion, thereby allowing visibility or airflow around and about materials contained in the storage basket.

11. The storage basket of claim 10, wherein the second portion is coupled to the first portion adjacent to a bottom perimeter edge of the upright wall.

12. The storage basket of claim 10, wherein the wire grid of the second portion comprises:

a plurality of first support members each having vertical portions coupled to the upright wall;

a plurality of second support members each having vertical portions coupled to the upright wall.

13. The storage basket of claim 12, wherein the first support member and the second support member are made from a metal wire, and the upright wall is formed from sheet metal.

14. The storage basket of claim 12, wherein the first support member and the second support member are made from a metal wire, and the upright wall is formed from one of a plastic material or a glass material.

15. The storage basket of claim 12, wherein the first support member, the second support member, and the upright wall are each formed from one of a plastic material or a glass material.

16. The storage basket of claim 10, wherein each of the front wall, the rear wall, the first side wall, and the second side wall includes a plurality of slots in the sheet material.

17. The storage basket of claim 10, wherein the second portion includes at least one side portion that is in a plane parallel to the first portion, and a bottom portion that is in a plane perpendicular to the first portion.

18. The storage basket of claim 10, wherein the linear axis extends in a vertical direction.

* * * * *